US009142344B2

(12) United States Patent
Tachibana et al.

(10) Patent No.: US 9,142,344 B2
(45) Date of Patent: Sep. 22, 2015

(54) ELECTRONIC COMPONENT

(71) Applicant: MURATA MANUFACTURING CO., LTD., Kyoto (JP)

(72) Inventors: Kaoru Tachibana, Kyoto (JP); Mitsuru Odahara, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/151,739

(22) Filed: Jan. 9, 2014

(65) Prior Publication Data

US 2014/0232504 A1 Aug. 21, 2014

(30) Foreign Application Priority Data

Feb. 15, 2013 (JP) ..... 2013-027798

(51) Int. Cl.
*H01F 5/00* (2006.01)
*H01F 27/24* (2006.01)
(Continued)

(52) U.S. Cl.
CPC ..... *H01F 27/2804* (2013.01); *H01F 17/0013* (2013.01); *H01F 27/292* (2013.01); *H01F 17/0033* (2013.01)

(58) Field of Classification Search
CPC ..... H01F 17/0013; H01F 17/0033; H01F 27/2804; H01F 27/292
USPC ..... 336/200, 233, 234, 147
See application file for complete search history.

(56) References Cited

U.S. PATENT DOCUMENTS 4,543,553 A * 9/1985 Mandai et al. ..... 336/83
5,251,108 A * 10/1993 Doshita ..... 361/792
(Continued)

FOREIGN PATENT DOCUMENTS

JP 05-057817 U 7/1993
JP H11-45809 A 2/1999
(Continued)

OTHER PUBLICATIONS

An Office Action; "Notification of Preliminary Rejection," issued by the Korean Intellectual Property Office on Dec. 12, 2014, which corresponds to Korean Patent Application No. 10-2014-0005493 and is related to U.S. Appl. No. 14/151,739; with English langauge translation.

(Continued)

*Primary Examiner* — Mangtin Lian
(74) *Attorney, Agent, or Firm* — Studebaker & Brackett PC

(57) ABSTRACT

An electronic component having a laminate having a plurality of insulator layers. A coil is provided consisting of a plurality of coil conductors that are connected by via-conductors piercing through the insulator layers, the coil winding helically about an axis along a direction of lamination. External electrodes are provided on surfaces of the laminate, in which at least some pairs of the coil conductors that neighbor each other with one of the insulator layers provided therebetween have parallel sections that overlap each other when viewed in the direction of lamination. The parallel sections are connected in parallel by the via-conductors or the external electrodes, and each pair of the coil conductors that neighbor each other with one of the insulator layers provided therebetween do not overlap each other when viewed in the direction of lamination, except for the parallel sections, and connections between the coil conductors and the via-conductors.

6 Claims, 8 Drawing Sheets

(51) Int. Cl.

| | |
|---|---|
| ***H01F 27/28*** | (2006.01) |
| ***H01F 17/00*** | (2006.01) |
| ***H01F 27/29*** | (2006.01) |

(56) References Cited

U.S. PATENT DOCUMENTS

| | | | | |
|---|---|---|---|---|
| 6,238,779 | B1 | 5/2001 | Iwao et al. | |
| 2003/0134612 | A1 | 7/2003 | Nakayama et al. | |
| 2008/0246579 | A1 | 10/2008 | Mizuno et al. | |
| 2009/0295525 | A1* | 12/2009 | Okawa | 336/192 |
| 2010/0127812 | A1 | 5/2010 | Maeda | |
| 2010/0253464 | A1* | 10/2010 | Miyoshi et al. | 336/200 |
| 2013/0214891 | A1 | 8/2013 | Maeda | |

FOREIGN PATENT DOCUMENTS

| | | | |
|---|---|---|---|
| JP | 2000-195720 | A | 7/2000 |
| JP | 2004-014534 | A | 1/2004 |
| JP | 2005-032757 | A | 2/2005 |
| JP | 2008-053368 | A | 3/2008 |
| JP | 2010-183007 | A | 8/2010 |
| JP | 2010-263059 | A | 11/2010 |
| JP | 2011-187535 | A | 9/2011 |
| JP | 2011-254115 | A | 12/2011 |
| WO | 01/067470 | A1 | 9/2001 |
| WO | 2007/072612 | A1 | 6/2007 |
| WO | 2012/020590 | A1 | 2/2012 |

OTHER PUBLICATIONS

An Office Action; "Notification of Reasons for Rejection," issued by the Japanese Patent Office on Dec. 24, 2014, which corresponds to Japanese Patent Application No. 2013-027798 and is related to U.S. Appl. No. 14/151,739; with English language translation.

* cited by examiner

ELECTRONIC COMPONENT

CROSS REFERENCE TO RELATED APPLICATIONS

This application claims benefit of priority to Japanese Patent Application No. 2013-027798 filed Feb. 15, 2013, the entire content of which is incorporated herein by reference.

TECHNICAL FIELD

The present disclosure relates to an electronic component including a laminate with an internal coil conductor.

BACKGROUND

As a conventional electronic component, a multilayer chip inductor disclosed in, for example, Japanese Utility Model Laid-Open Publication No. 5-57817 is known. The multilayer chip inductor disclosed in Japanese Utility Model Laid-Open Publication No. 5-57817 will be described below. FIG. 8 is an exploded oblique view of the multilayer chip inductor 500 disclosed in Japanese Utility Model Laid-Open Publication No. 5-57817.

The multilayer chip inductor 500 is formed by laminating a plurality of pieces of rectangular ferrite green sheets 501, and forming coil patterns 503 on some of the ferrite green sheets 501. Note that the coil patterns 503 are connected by through-hole conductors, and connected at the start and the end to external electrodes.

In the multilayer chip inductor 500, to reduce electrical resistance of the coil patterns 503, two pieces of ferrite green sheets 501 with the coil patterns 503 of the same shape formed thereon are stacked at a time, and the ends of the coil patterns 503 of the same shape are connected in parallel by the through-hole conductors, as shown in FIG. 8. That is, the multilayer chip inductor 500 is a multilayer chip inductor of a so-called multiturn type.

Incidentally, some of the coil patterns 503 of the multilayer chip inductor 500 are opposed and connected in a series to another coil pattern with one ferrite green sheet provided therebetween. For example, the coil patterns 503*a* and 503*b* shown in FIG. 8 are such coil patterns. Since the coil patterns 503*a* and 503*b* are connected in a series, there is a potential difference between a point P503*a* on the coil pattern 503*a* and a point P503*b* on the coil pattern 503*b*. Moreover, there is only one ferrite green sheet between the points P503*a* and P503*b*, and the points P503*a* and P503*b* overlap each other when they are viewed in a plan view in the direction of lamination. That is, the points P503*a* and P503*b* are located in proximity. In addition, since the multilayer chip inductor is of a multiturn type, typically, a relatively large current of 1 ampere [A] or more is assumed to flow therethrough. For the above reasons, the multilayer chip inductor 500 is susceptible to migration of silver or suchlike used in the coil patterns 503 between the points P503*a* and P503*b* (hereinafter, such a phenomenon will also be referred to as "metal migration"). As a result, the multilayer chip inductor 500 is susceptible to short-circuiting, so that the allowable ampacity of the multilayer chip inductor 500 is limited.

SUMMARY

An electronic component according to an embodiment of the present disclosure includes: a laminate formed by laminating a plurality of insulator layers; a coil provided in the laminate and consisting of a plurality of coil conductors that are connected by via-conductors piercing through the insulator layers, the coil winding helically about an axis along a direction of lamination; and external electrodes provided on surfaces of the laminate, in which at least some pairs of the coil conductors that neighbor each other with one of the insulator layers provided therebetween have parallel sections that overlap each other when viewed in the direction of lamination, the parallel sections are connected in parallel by the via-conductors or the external electrodes, and each pair of the coil conductors that neighbor each other with one of the insulator layers provided therebetween do not overlap each other when viewed in the direction of lamination, except for the parallel sections, and connections between the coil conductors and the via-conductors.

DETAILED DESCRIPTION

First Example

Figure 1:
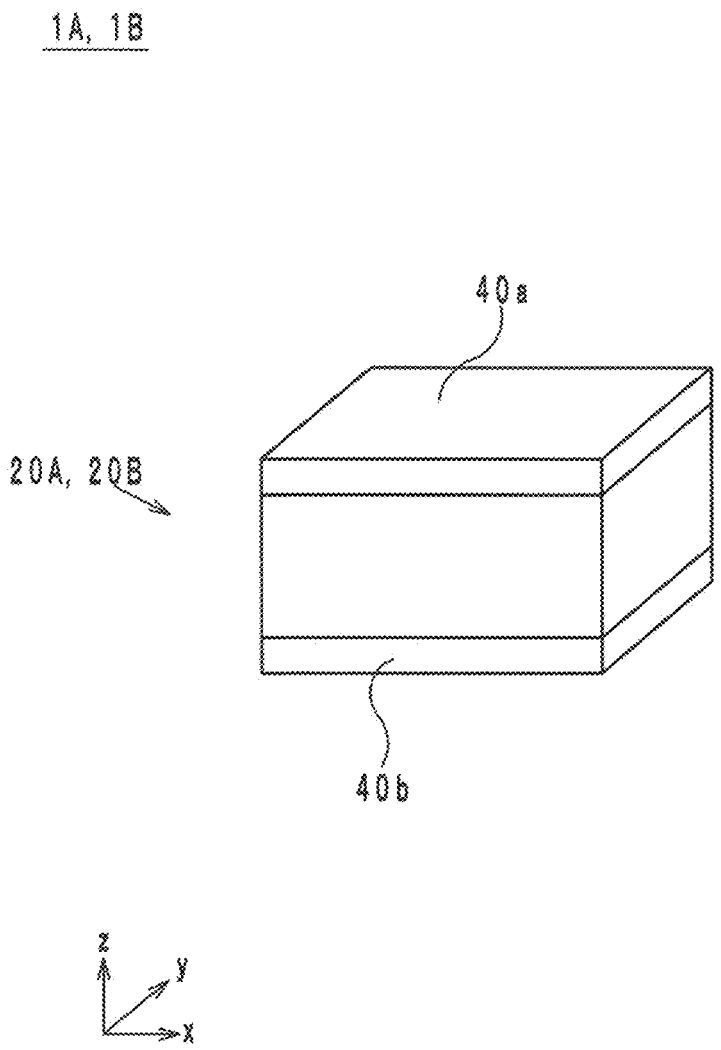
FIG. 1 is an external oblique view of an electronic component to be referenced in relation to first and second examples.
Figure 2:
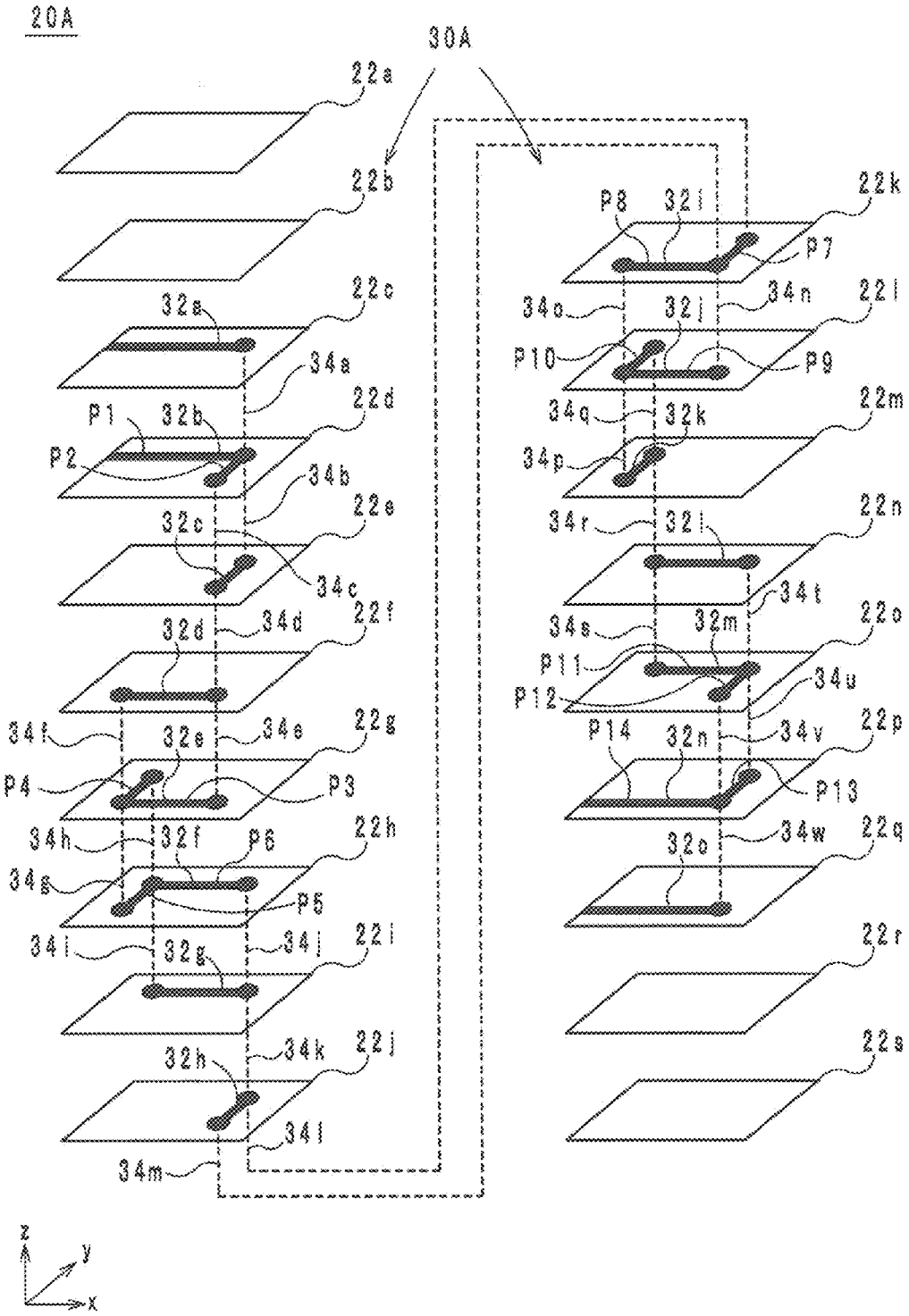
FIG. 2 is an exploded oblique view of the electronic component described as the first example.

Hereinafter, the configuration of an electronic component 1A, which is a first example of the present disclosure, will be described with reference to the drawings. FIG. 1 is an external oblique view of the electronic component 1A described as the first example of the present disclosure. FIG. 2 is an exploded oblique view of the electronic component 1A described as the first example. In the following, the direction of lamination of the electronic component 1A will be defined as a z-axis direction. Moreover, when viewed in a plan view in the z-axis direction, the direction along the long side of the electronic component 1A will be referred to as an x-axis direction, and the direction along the short side of the electronic component 1A will be defined as a y-axis direction. Note that the x-, y- and z-axes are perpendicular to one another.

The electronic component 1A includes a laminate 20A, a coil 30A, and external electrodes 40*a* and 40*b*. In addition, the electronic component 1A is in the shape of a rectangular solid, as shown in FIG. 1.

The laminate 20A is formed by laminating insulator layers 22*a* to 22*s* in this order, from the positive side in the z-axis direction, as shown in FIG. 2. Moreover, each of the insulator layers 22*a* to 22*s* is rectangular when viewed in a plan view in the z-axis direction. Accordingly, the laminate 20A formed by laminating the insulator layers 22*a* to 22*s* is in the shape of a rectangular solid, as shown in FIG. 1. In addition, the laminate 20A has the coil 30A provided therein. Note that in the following, the surface of each of the insulator layers 22*a* to 22*s* that is located on the positive side in the z-axis direction will be referred to as the top surface, and the surface of each of the insulator layers 22*a* to 22*s* that is located on the negative side in the z-axis direction will be referred to as the bottom surface. In addition, an example of the material of the insulator layers 22*a* to 22*s* is ferrite.

The external electrode 40*a* is provided so as to cover the surface of the laminate 20A that is located on the positive side in the z-axis direction and also partially cover its peripheral surfaces, as shown in FIG. 1. Moreover, the external electrode 40*b* is provided so as to cover the surface of the laminate 20A that is located on the negative side in the z-axis direction and also partially cover its peripheral surfaces. Note that the external electrodes 40*a* and 40*b* are made of a conductive material such as Au, Ag, Pd, Cu, or Ni.

The coil 30A is provided in the laminate 20A, and is configured by coil conductors 32*a* to 32*o* and via-conductors 34*a* to 34*w*, as shown in FIG. 2. Moreover, the coil 30A is in a helical form having a central axis parallel to the z-axis. That is, the coil 30A winds helically in the direction of lamination. Note that the coil 30A is made of a conductive material such as Ag, Pd, Cu, or Ni.

The coil conductor 32*a* is a linear conductor provided on the top surface of the insulator layer 22*c*, as shown in FIG. 2. In addition, the coil conductor 32*a* follows alongside the edge of the insulator layer 22*c* that is located on the positive side in the y-axis direction. That is, the coil conductor 32*a* extends on the insulator layer 22*c* in the x-axis direction. Moreover, one end of the coil conductor 32*a* that is located on the negative side in the x-axis direction is exposed from the surface of the laminate 20A, and is connected to the external electrode 40*a*. In addition, the other end of the coil conductor 32*a*, which is located on the positive side in the x-axis direction, is connected to the via-conductor 34*a*, which pierces through the insulator layer 22*c* in the z-axis direction.

The coil conductor 32*b* is a linear conductor provided on the top surface of the insulator layer 22*d*, as shown in FIG. 2. Accordingly, the coil conductor 32*b* neighbors the coil conductor 32*a* with the insulator layer 22*c* provided therebetween. Moreover, the coil conductor 32*b*, when viewed in the direction of lamination, has an L-like shape with the long part (section P1) following alongside the edge of the insulator layer 22*d* that is located on the positive side in the y-axis direction, and the short part (section P2) following alongside the edge of the insulator layer 22*d* that is located on the positive side in the x-axis direction.

Section P1 follows alongside the edge of the insulator layer 22*d* that is located on the positive side in the y-axis direction, such that section P1, when viewed in the z-axis direction, overlaps the coil conductor 32*a*. That is, one of the sections of the coil conductor 32*b* is parallel to the coil conductor 32*a* paired therewith. Moreover, one end of section P1 that is located on the negative side in the x-axis direction is exposed from the surface of the laminate 20A, and is connected to the external electrode 40*a*. In addition, the other end of section P1, which is located on the positive side in the x-axis direction, is connected to the via-conductor 34*a*. As a result, section P1 of the coil conductor 32*b* is connected parallel to the coil conductor 32*a*. Moreover, section P2 follows alongside the edge of the insulator layer 22*d* that is located on the positive side in the x-axis direction. One end of section P2 that is located on the positive side in the y-axis direction overlaps section P1, and is connected to the via-conductor 34*b*, which pierces through the insulator layer 22*d* in the z-axis direction. Moreover, the other end of section P2, which is located on the negative side in the y-axis direction, is connected to the via-conductor 34*c*, which pierces through the insulator layer 22*d* in the z-axis direction. Note that the coil conductors 32*a* and 32*b*, when viewed in the z-axis direction, do not overlap each other except for section P1.

The coil conductor 32*c* is a linear conductor provided on the top surface of the insulator layer 22*e*, as shown in FIG. 2. Accordingly, the coil conductor 32*c* neighbors the coil conductor 32*b* with the insulator layer 22*d* provided therebetween. Moreover, the coil conductor 32*c* follows alongside the edge of the insulator layer 22*e* that is located on the positive side in the x-axis direction. Accordingly, the coil conductor 32*c*, when viewed in the direction of lamination, overlaps section P2 of the coil conductor 32*b*. That is, the coil conductor 32*c* is parallel to one of the sections of the coil conductor 32*b* paired therewith. Moreover, one end of the coil conductor 32*c* that is located on the positive side in the y-axis direction is connected to the via-conductor 34*b*, and the other end of the coil conductor 32*c*, which is located on the negative side in the y-axis direction, is connected to the via-conductor 34*c* and the via-conductor 34*d*, which pierces through the insulator layer 22*e* in the z-axis direction. As a result, the coil conductor 32*c* is connected parallel to section P2 of the coil conductor 32*b*. Note that the coil conductors 32*b* and 32*c*, when viewed in the z-axis direction, do not overlap each other except for section P2.

The coil conductor 32*d* is a linear conductor provided on the top surface of the insulator layer 22*f*, as shown in FIG. 2. Accordingly, the coil conductor 32*d* neighbors the coil conductor 32*c* with the insulator layer 22*e* provided therebetween. Moreover, the coil conductor 32*d* follows alongside the edge of the insulator layer 22*f* that is located on the negative side in the y-axis direction. In addition, one end of the coil conductor 32*d* that is located on the positive side in the x-axis direction is connected to the via-conductor 34*d* and the via-conductor 34*e*, which pierces through the insulator layer 22*f* in the z-axis direction. As a result, the coil conductor 32*d* is electrically connected to the coil conductor 32*c*. Further, the other end of the coil conductor 32*d*, which is located on the negative side in the x-axis direction, is connected to the via-conductor 34*f*, which pierces through the insulator layer 22*f* in the z-axis direction. Note that the coil conductors 32*c* and 32*d*, when viewed in the z-axis direction, do not overlap each other except for their connections with the via-conductor 34*d*.

The coil conductor 32*e* is a linear conductor provided on the top surface of the insulator layer 22*g*, as shown in FIG. 2. Accordingly, the coil conductor 32*e* neighbors the coil conductor 32*d* with the insulator layer 22*f* provided therebetween. Moreover, the coil conductor 32*e*, when viewed in the direction of lamination, has an L-like shape with the long part (section P3) following alongside the edge of the insulator layer 22*g* that is located on the negative side in the y-axis direction, and the short part (section P4) following alongside the edge of the insulator layer 22*g* that is located on the negative side in the x-axis direction.

Section P3 follows alongside the edge of the insulator layer 22*g* that is located on the negative side in the y-axis direction, such that section P3, when viewed in the z-axis direction, overlaps the coil conductor 32*d*. That is, one of the sections of the coil conductor 32*e* is parallel to the coil conductor 32*d* paired therewith. Moreover, one end of section P3 that is located on the positive side in the x-axis direction is connected to the via-conductor 34*e*, and the other end of section P3, which is located on the negative side in the x-axis direction, is connected to the via-conductor 34*f*. As a result, section P3 of the coil conductor 32*e* is connected parallel to the coil conductor 32*d*. Moreover, section P4 follows alongside the edge of the insulator layer 22*g* that is located on the negative side in the x-axis direction. One end of section P4 that is located on the negative side in the y-axis direction overlaps the end of section P3 that is on the negative side in the x-axis direction, and is connected to the via-conductor 34*g*, which pierces through the insulator layer 22*g* in the z-axis direction. Moreover, the other end of section P4, which is located on the positive side in the y-axis direction, is connected to the via-conductor 34*h*, which pierces through the insulator layer 22*g* in the z-axis direction. Note that the coil conductors 32*d* and 32*e*, when viewed in the z-axis direction, do not overlap each other except for section P3.

The coil conductor 32*f* is a linear conductor provided on the top surface of the insulator layer 22*h*, as shown in FIG. 2. Accordingly, the coil conductor 32*f* neighbors the coil conductor 32*e* with the insulator layer 22*g* provided therebetween. Moreover, the coil conductor 32*f*, when viewed in the direction of lamination, has an L-like shape with the short part (section P5) following alongside the edge of the insulator layer 22*h* that is located on the negative side in the x-axis direction, and the long part (section P6) following alongside the edge of the insulator layer 22*h* that is located on the positive side in the y-axis direction.

Section P5 follows alongside the edge of the insulator layer 22*h* that is located on the negative side in the x-axis direction, such that section P5, when viewed in the z-axis direction, overlaps section P4 of the coil conductor 32*e*. That is, one of the sections of the coil conductor 32*f* is parallel to the coil conductor 32*e* paired therewith. Moreover, one end of section P5 that is located on the negative side in the y-axis direction is connected to the via-conductor 34*g*, and the other end of section P5, which is located on the positive side in the y-axis direction, is connected to the via-conductor 34*h*. As a result, section P5 of the coil conductor 32*f* is connected parallel to section P4 of the coil conductor 32*e*. Moreover, section P6 follows alongside the edge of the insulator layer 22*h* that is located on the positive side in the y-axis direction. One end of section P6 that is located on the negative side in the x-axis direction overlaps the end of section P5 that is on the positive side in the y-axis direction, and is connected to the via-conductor 34*i*, which pierces through the insulator layer 22*h* in the z-axis direction. Moreover, the other end of section P6, which is located on the positive side in the x-axis direction, is connected to the via-conductor 34*j*, which pierces through the insulator layer 22*h* in the z-axis direction. Note that the coil conductors 32*e* and 32*f*, when viewed in the z-axis direction, do not overlap each other except for section P5 (or P4).

The coil conductor 32*g* is a linear conductor provided on the top surface of the insulator layer 22*i*, as shown in FIG. 2. Accordingly, the coil conductor 32*g* neighbors the coil conductor 32*f* with the insulator layer 22*h* provided therebetween. Moreover, the coil conductor 32*g* follows alongside the edge of the insulator layer 22*i* that is located on the positive side in the y-axis direction. Accordingly, the coil conductor 32*g*, when viewed in the direction of lamination, overlaps section P6 of the coil conductor 32*f*. That is, the coil conductor 32*g* is parallel to one of the sections of the coil conductor 32*f* paired therewith. Moreover, one end of the coil conductor 32*g* that is located on the negative side in the x-axis direction is connected to the via-conductor 34*i*, and the other end of the coil conductor 32*g*, which is located on the positive side in the x-axis direction, is connected to the via-conductor 34*j* and the via-conductor 34*k*, which pierces through the insulator layer 22*i* in the z-axis direction. As a result, the coil conductor 32*g* is connected parallel to section P6 of the coil conductor 32*f*. Note that the coil conductors 32*f* and 32*g*, when viewed in the z-axis direction, do not overlap each other except for section P6.

The coil conductor 32*h* is a linear conductor provided on the top surface of the insulator layer 22*j*, as shown in FIG. 2. Accordingly, the coil conductor 32*h* neighbors the coil conductor 32*g* with the insulator layer 22*i* provided therebetween. Moreover, the coil conductor 32*h* follows alongside the edge of the insulator layer 22*j* that is located on the positive side in the x-axis direction. In addition, one end of the coil conductor 32*h* that is located on the positive side in the y-axis direction is connected to the via-conductor 34*k* and the via-conductor 34*l*, which pierces through the insulator layer 22*j* in the z-axis direction. As a result, the coil conductor 32*h* is electrically connected to the coil conductor 32*g*. Further, the other end of the coil conductor 32*h*, which is located on the negative side in the y-axis direction, is connected to the via-conductor 34*m*, which pierces through the insulator layer 22*j* in the z-axis direction. Note that the coil conductors 32*g* and 32*h*, when viewed in the z-axis direction, do not overlap each other except for their connections with the via-conductor 34*k*.

The coil conductor 32*i* is a linear conductor provided on the top surface of the insulator layer 22*k*, as shown in FIG. 2. Accordingly, the coil conductor 32*i* neighbors the coil conductor 32*h* with the insulator layer 22*j* provided therebetween. Moreover, the coil conductor 32*i*, when viewed in the direction of lamination, has an L-like shape with the short part (section P7) following alongside the edge of the insulator layer 22*k* that is located on the positive side in the x-axis direction, and the long part (section P8) following alongside the edge of the insulator layer 22*k* that is located on the negative side in the y-axis direction.

Section P7 follows alongside the edge of the insulator layer 22*k* that is located on the positive side in the x-axis direction, such that section P7, when viewed in the z-axis direction, overlaps the coil conductor 32*h*. That is, one of the sections of the coil conductor 32*i* is parallel to the coil conductor 32*h* paired therewith. Moreover, one end of section P7 that is located on the positive side in the y-axis direction is connected to the via-conductor 34*l*, and the other end of section P7, which is located on the negative side in the y-axis direction, is connected to the via-conductor 34*m*. As a result, section P7 of the coil conductor 32*i* is connected parallel to the coil conductor 32*h*. Moreover, section P8 follows alongside the edge of the insulator layer 22*k* that is located on the negative side in the y-axis direction. One end of section P8 that is located on the positive side in the x-axis direction overlaps the end of section P7 that is on the negative side in the y-axis direction, and is connected to the via-conductor 34*n*, which pierces through the insulator layer 22*k* in the z-axis direction. Moreover, the other end of section P8, which is located on the negative side in the x-axis direction, is connected to the via-conductor 34*o*, which pierces through the insulator layer 22*k* in the z-axis direction. Note that the coil conductors 32*h* and 32*i*, when viewed in the z-axis direction, do not overlap each other except for section P7.

The coil conductor 32*j* is a linear conductor provided on the top surface of the insulator layer 22*l*, as shown in FIG. 2. Accordingly, the coil conductor 32*j* neighbors the coil conductor 32*i* with the insulator layer 22*k* provided therebetween. Moreover, the coil conductor 32*j*, when viewed in the direction of lamination, has an L-like shape with the long part (section P9) following alongside the edge of the insulator layer 22*l* that is located on the negative side in the y-axis direction, and the short part (section P10) following alongside the edge of the insulator layer 22*l* that is located on the negative side in the x-axis direction.

Section P9 follows alongside the edge of the insulator layer 22*l* that is located on the negative side in the y-axis direction, such that section P9, when viewed in the z-axis direction, overlaps section P8 of the coil conductor 32*i*. That is, one of the sections of the coil conductor 32*j* is parallel to the coil conductor 32*i* paired therewith. Moreover, one end of section P9 that is located on the positive side in the x-axis direction is connected to the via-conductor 34*n*, and the other end of section P9, which is located on the negative side in the x-axis direction, is connected to the via-conductor 34*o*. As a result, section P9 of the coil conductor 32*j* is connected parallel to section P8 of the coil conductor 32*i*. Moreover, section P10 follows alongside the edge of the insulator layer 22*l* that is located on the negative side in the x-axis direction. One end of section P10 that is located on the negative side in the y-axis direction overlaps the end of section P9 that is on the negative side in the x-axis direction, and is connected to the via-conductor 34*p*, which pierces through the insulator layer 22*l* in the z-axis direction. Moreover, the other end of section P10, which is located on the positive side in the y-axis direction, is connected to the via-conductor 34*q*, which pierces through the insulator layer 22*l* in the z-axis direction. Note that the coil conductors 32*i* and 32*j*, when viewed in the z-axis direction, do not overlap each other except for section P9 (or P8).

The coil conductor 32*k* is a linear conductor provided on the top surface of the insulator layer 22*m*, as shown in FIG. 2. Accordingly, the coil conductor 32*k* neighbors the coil conductor 32*j* with the insulator layer 22*l* provided therebetween. Moreover, the coil conductor 32*k* follows alongside the edge of the insulator layer 22*m* that is located on the negative side in the x-axis direction. Accordingly, the coil conductor 32*k*, when viewed in the direction of lamination, overlaps section P10 of the coil conductor 32*j*. That is, the coil conductor 32*k* is parallel to one of the sections of the coil conductor 32*j* paired therewith. Moreover, one end of the coil conductor 32*k* that is located on the negative side in the y-axis direction is connected to the via-conductor 34*p*, and the other end of the coil conductor 32*k*, which is located on the positive side in the y-axis direction, is connected to the via-conductor 34*q* and the via-conductor 34*r*, which pierces through the insulator layer 22*m* in the z-axis direction. As a result, the coil conductor 32*k* is connected parallel to section P10 of the coil conductor 32*j*. Note that the coil conductors 32*j* and 32*k*, when viewed in the z-axis direction, do not overlap each other except for section P10.

The coil conductor 32*l* is a linear conductor provided on the top surface of the insulator layer 22*n*, as shown in FIG. 2. Accordingly, the coil conductor 32*l* neighbors the coil conductor 32*k* with the insulator layer 22*m* provided therebetween. Moreover, the coil conductor 32*l* follows alongside the edge of the insulator layer 22*n* that is located on the positive side in the y-axis direction. In addition, one end of the coil conductor 32*l* that is located on the negative side in the x-axis direction is connected to the via-conductor 34*r* and the via-conductor 34*s*, which pierces through the insulator layer 22*n* in the z-axis direction. As a result, the coil conductor 32*l* is electrically connected to the coil conductor 32*k*. Further, the other end of the coil conductor 32*l*, which is located on the positive side in the x-axis direction, is connected to the via-conductor 34*t*, which pierces through the insulator layer 22*n* in the z-axis direction. Note that the coil conductors 32*k* and 32*l*, when viewed in the z-axis direction, do not overlap each other except for their connections with the via-conductor 34*r*.

The coil conductor 32*m* is a linear conductor provided on the top surface of the insulator layer 22*o*, as shown in FIG. 2. Accordingly, the coil conductor 32*m* neighbors the coil conductor 32*l* with the insulator layer 22*n* provided therebetween. Moreover, the coil conductor 32*m*, when viewed in the direction of lamination, has an L-like shape with the long part (section P11) following alongside the edge of the insulator layer 22*o* that is located on the positive side in the y-axis direction, and the short part (section P12) following alongside the edge of the insulator layer 22*o* that is located on the positive side in the x-axis direction.

Section P11 follows alongside the edge of the insulator layer 22*o* that is located on the positive side in the y-axis direction, such that section P11, when viewed in the z-axis direction, overlaps the coil conductor 32*l*. That is, one of the sections of the coil conductor 32*m* is parallel to the coil conductor 32*l* paired therewith. Moreover, one end of section P11 that is located on the negative side in the x-axis direction is connected to the via-conductor 34*s*, and the other end of section P11, which is located on the positive side in the x-axis direction, is connected to the via-conductor 34*t*. As a result, section P11 of the coil conductor 32*m* is connected parallel to the coil conductor 32*l*. Moreover, section P12 follows alongside the edge of the insulator layer 22*o* that is located on the positive side in the x-axis direction. One end of section P12 that is located on the positive side in the y-axis direction overlaps the end of section P11 that is on the positive side in the x-axis direction, and is connected to the via-conductor 34*u*, which pierces through the insulator layer 22*o* in the z-axis direction. Moreover, the other end of section P12, which is located on the negative side in the y-axis direction, is connected to the via-conductor 34*v*, which pierces through the insulator layer 22*o* in the z-axis direction. Note that the coil conductors 32*l* and 32*m*, when viewed in the z-axis direction, do not overlap each other except for section P11.

The coil conductor 32*n* is a linear conductor provided on the top surface of the insulator layer 22*p*, as shown in FIG. 2. Accordingly, the coil conductor 32*n* neighbors the coil conductor 32*m* with the insulator layer 22*o* provided therebetween. Moreover, the coil conductor 32*n*, when viewed in the direction of lamination, has an L-like shape with the short part (section P13) following alongside the edge of the insulator layer 22*p* that is located on the positive side in the x-axis direction, and the long part (section P14) following alongside the edge of the insulator layer 22*p* that is located on the negative side in the y-axis direction.

Section P13 follows alongside the edge of the insulator layer 22*p* that is located on the positive side in the x-axis direction, such that section P13, when viewed in the z-axis direction, overlaps section P12 of the coil conductor 32*m*. That is, one of the sections of the coil conductor 32*n* is parallel to the coil conductor 32*m* paired therewith. Moreover, one end of section P13 that is located on the positive side in the y-axis direction is connected to the via-conductor 34*u*, and the other end of section P13, which is located on the negative side in the y-axis direction, is connected to the via-conductor 34*v*. As a result, section P13 of the coil conductor 32*n* is connected parallel to section P12 of the coil conductor 32*m*. One end of section P14 that is located on the positive side in the x-axis direction overlaps the end of section P13 that is on the negative side in the y-axis direction, and is connected to the via-conductor 34*w*, which pierces through the insulator layer 22*p* in the z-axis direction. Moreover, the other end of section P14, which is located on the negative side in the x-axis direction, is exposed from the surface of the laminate 20A, and is connected to the external electrode 40*b*. Note that the coil conductors 32*m* and 32*n*, when viewed in the z-axis direction, do not overlap each other except for section P13 (or P12).

The coil conductor 32*o* is a linear conductor provided on the top surface of the insulator layer 22*q*, as shown in FIG. 2. Accordingly, the coil conductor 32*o* neighbors the coil conductor 32*n* with the insulator layer 22*p* provided therebetween. Moreover, the coil conductor 32*o*, when viewed in the direction of lamination, follows alongside the edge of the insulator layer 22*q* that is located on the negative side in the y-axis direction. Accordingly, the coil conductor 32*o*, when viewed in the direction of lamination, overlaps with section P14 of the coil conductor 32*n*. That is, the coil conductor 32*o* is parallel to one of the sections of the coil conductor 32*n* paired therewith. Moreover, one end of the coil conductor 32*o* that is located on the positive side in the x-axis direction is connected to the via-conductor 34*w*. In addition, the other end of the coil conductor 32*o*, which is located on the negative side in the x-axis direction, is exposed from the surface of the laminate 20A, and is connected to the external electrode 40*b*. As a result, section P14 of the coil conductor 32*n* is connected parallel to the coil conductor 32*o*. Note that the coil conductors 32*n* and 32*o*, when viewed in the z-axis direction, do not overlap each other except for section P14.

Production Method

The method for producing the electronic component 1A thus configured will be described below. While the following description focuses on one electronic component 1A, in actuality, a mother laminate for a plurality of unsintered laminates 20A is produced and cut, and thereafter, external electrodes 40*a* and 40*b* are formed to obtain a plurality of electronic components 1A.

Initially, ceramic green sheets from which to make insulator layers 22*a* to 22*s* are prepared. Specifically, materials weighed at a predetermined ratio, including ferric oxide ($Fe_2O_3$), zinc oxide (ZnO), and nickel oxide (NiO), are introduced into a ball mill as raw materials, and subjected to wet mixing. The resultant mixture is dried and ground to obtain powder, which is pre-sintered. Further, the pre-sintered powder is subjected to wet grinding in the ball mill, and thereafter dried and cracked to obtain ferrite ceramic powder.

To the ferrite ceramic powder, a binder (vinyl acetate, water-soluble acrylic, or the like), a plasticizer, a wetting agent, and a dispersing agent are added and mixed in the ball mill, and thereafter defoamed under reduced pressure. The resultant ceramic slurry is spread over carrier sheets by a doctor blade method and dried to form ceramic green sheets from which to make insulator layers 22*a* to 22*s*.

Next, ceramic green sheets from which to make insulator layers 22*c* to 22*p* are irradiated with laser beams at positions where via-hole conductors 34*a* to 34*w* are to be formed, thereby boring via-holes through the sheets. In addition, a conductive paste mainly composed of, for example, Au, Ag, Pd, Cu, or Ni is applied to fill the via-holes, thereby forming via-hole conductors 34*a* to 34*w*. Note that filling the via holes with the conductive paste and forming coil conductors 32*a* to 32*o* to be described later may be included in the same step.

Next, a conductive paste mainly composed of, for example, Au, Ag, Pd, Cu, or Ni is applied by screen printing or photolithography onto the ceramic green sheets from which to make insulator layers 22*c* to 22*q*, thereby forming coil conductors 32*a* to 32*o*.

Next, the ceramic green sheets from which to make insulator layers 22*a* to 22*s* are laminated in this order and subjected to pressure-bonding, thereby obtaining an unsintered mother laminate. Thereafter, the unsintered mother laminate is firmly bonded under pressure, for example, by isostatic pressing.

Next, the mother laminate is cut by a cutter into a predetermined size, thereby obtaining unsintered laminates 20A. Thereafter, each of the unsintered laminates 20A is subjected to debinding and sintering. The debinding is performed, for example, in a low-oxygen atmosphere at 500° C. for two hours. The sintering is performed, for example, at 800° C. to 900° C. for 2.5 hours.

Next, external electrodes 40*a* and 40*b* are formed. Initially, an electrode paste, which is made of a conductive material mainly composed of Ag, is applied onto the surface of the laminate 20A. Then, the applied electrode paste is baked at about 800° C. for one hour. As a result, bases of the external electrodes 40*a* and 40*b* are formed.

Lastly, the surfaces of the bases are plated with Ni or Sn. As a result, the external electrodes 40*a* and 40*b* are formed. By the foregoing process, the electronic component 1A is completed.

Effects

The electronic component 1A thus configured renders it possible to inhibit occurrence of short-circuiting due to metal migration. Specifically, in the electronic component 1A, the coil conductors 32*a* to 32*o*, each being paired with a neighboring coil conductor with one of the insulator layers 22*c* to 22*p* provided therebetween, do not overlap their respective neighboring coil conductors except for their portions connected parallel to sections P1 to P14 and the via-conductors 34*a* to 34*w*. As a result, conductors with different potentials are not positioned in proximity with each other. For example, the pair of coil conductors 32*c* and 32*d* neighbor each other with the insulator layer 22*e* provided therebetween, but the coil conductors 32*c* and 32*d*, when viewed in the z-axis direction, do not overlap each other except for their connections with the via-conductor 34*d*. That is, portions of the coil conductors 32*c* and 32*d* where there are electric potential differences are not positioned in proximity. Therefore, occurrence of metal migration between the coil conductors 32*c* and 32*d* is inhibited. As a result, occurrence of short-circuiting between the coil conductors 32*c* and 32*d* is inhibited. This is also true for the other pairs of coil conductors.

Furthermore, portions that neighbor each other with one of the insulator layers 22*c* to 22*p* provided therebetween and overlap each other when viewed in the z-axis direction, e.g., the coil conductor 32*a* and section P1 of the coil conductor 32*b*, are connected in parallel. Accordingly, there is basically no potential difference between the coil conductor 32*a* and section P1 of the coil conductor 32*b*. Therefore, occurrence of metal migration between the coil conductor 32*a* and section P1 of the coil conductor 32*b* is inhibited. Moreover, because the coil conductor 32*a* and section P1 of the coil conductor 32*b* are connected in parallel, there is no problem if short-circuiting due to metal migration occurs therebetween. This is also true for the other pairs of coil conductors. Thus, the electronic component 1A renders it possible to inhibit occurrence of short-circuiting due to metal migration.

Furthermore, in the electronic component 1A, coil conductors with different potentials do not closely neighbor each other with only one insulator layer provided therebetween, as described above, and therefore, occurrence of floating capacitance between the coil conductors is inhibited.

Furthermore, in the electronic component 1A, the coil conductors 32*a* to 32*o*, each being paired with a neighboring coil conductor with one of the insulator layers 22*c* to 22*p* provided therebetween, except for the pairs of coil conductors 32*c* and 32*d*, coil conductors 32*g* and 32*h*, and coil conductors 32*k* and 32*l*, have portions connected in parallel. Thus, the electronic component 1A has lower electrical resistance than electronic components without portions connected in parallel.

Second Example

Figure 3:
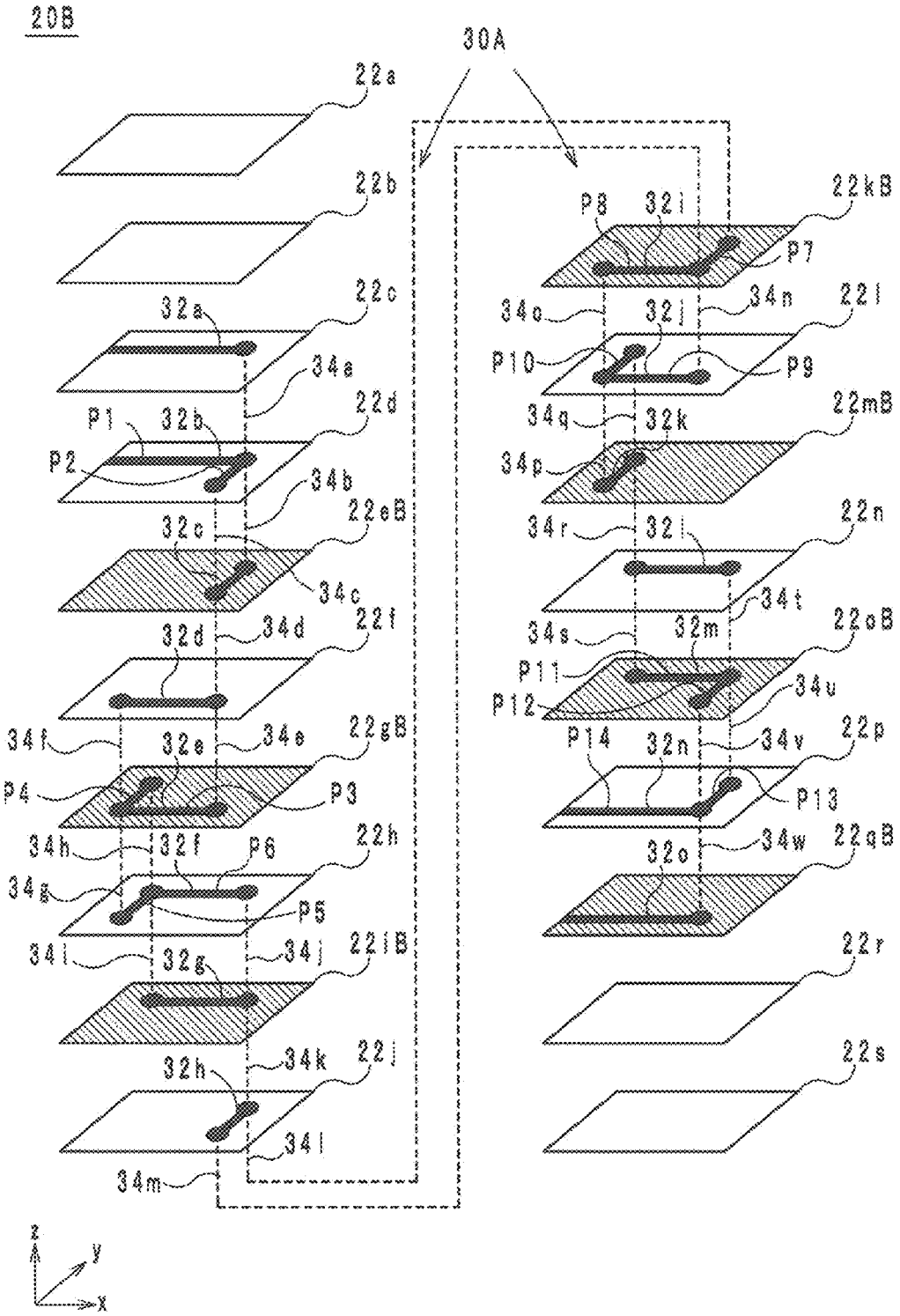
FIG. 3 is an exploded oblique view of the electronic component described as the second example.

The configuration of an electronic component 1B, which is a second example, will be described below with reference to the drawings. FIG. 3 is an exploded oblique view of the electronic component 1B described as the second example. Note that the definitions of the x-, y-, and z-axis directions in FIG. 3 are the same as in FIG. 2. For the external view of the second example, FIG. 1 will be referenced.

The electronic component 1B differs from the electronic component 1A described as the first example in terms of the material of the insulator layers 22*e*, 22*g*, 22*i*, 22*k*, 22*m*, 22*o*, and 22*q*. There is no other difference between the electronic components 1A and 1B, and any descriptions of common points therebetween will be omitted. Note that the laminate of the electronic component 1B will be denoted by 20B, and insulator layers made of a different material from the insulator layers of the electronic component 1A will be denoted by 22*e*B, 22*g*B, 22*i*B, 22*k*B, 22*m*B, 22*o*B, and 22*q*B. Moreover, in FIG. 3, the same elements as in the electronic component 1A are denoted by the same reference characters.

The insulator layers (second insulator layers) 22*e*B, 22*g*B, 22*i*B, 22*k*B, 22*m*B, 22*o*B, and 22*q*B of the electronic component 1B are denser than the other insulator layers (first insulator layers) 22*a* to 22*d*, 22*f*, 22*h*, 22*j*, 22*l*, 22*n*, 22*p*, 22*r*, and 22*s*. Specifically, the insulator layers 22*e*B, 22*g*B, 22*i*B, 22*k*B, 22*m*B, 22*o*B, and 22*q*B have lower porosity than the other insulator layers 22*a* to 22*d*, 22*f*, 22*h*, 22*j*, 22*l*, 22*n*, 22*p*, 22*r*, and 22*s*.

The electronic component 1B thus configured renders it possible to inhibit occurrence of metal migration more than the electronic component 1A. Specifically, the electronic component 1B has high-density insulator layers between coil conductors that are separated by more than one of the insulator layers 22*c* to 22*p*, that overlap each other when viewed in the z-axis direction, and that are connected in a series, e.g., the insulator layers 22*e*B and 22*g*B between section P1 of the coil conductor 32*b* and section P6 of the coil conductor 32*f*. Therefore, metal ions in, for example, silver, which is the material of the coil conductors, are prevented from moving between sections P1 and P6, which differ in potential. That is, the electronic component 1B renders it possible to inhibit occurrence of metal migration more than the electronic component 1A. Moreover, the electronic component 1B has high-density insulator layers 22*i*B, 22*k*B, 22*m*B, and 22*o*B between coil conductors other than the coil conductors 32*b* and 32*f*, and effects similar to the aforementioned effect can be achieved.

Furthermore, in the electronic component 1B, the insulator layers 22*d*, 22*f*, 22*h*, 22*j*, 22*l*, 22*n*, 22*p*, and 22*r* are laminated so as to alternate the denser insulator layers 22*e*B, 22*g*B, 22*i*B, 22*k*B, 22*m*B, 22*o*B, and 22*q*B. That is, in the electronic component 1B, the high-density insulator layers are not arranged in a non-uniform manner within the laminate. Thus, the electronic component 1B does not have non-uniform sintering residual stress, so that post-sintering breakage due to residual stress can be inhibited.

Third Example

Figure 4:
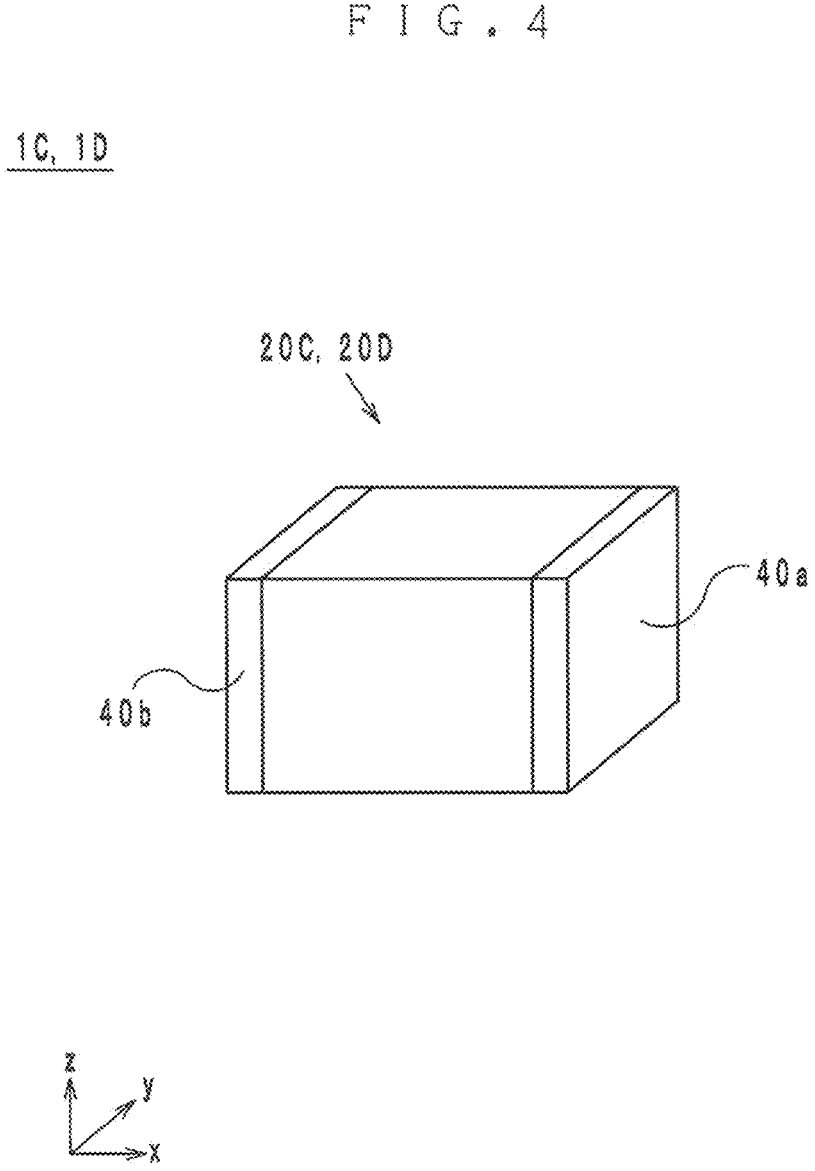
FIG. 4 is an external oblique view of an electronic component to be referenced in relation to third and fourth examples.
Figure 5:
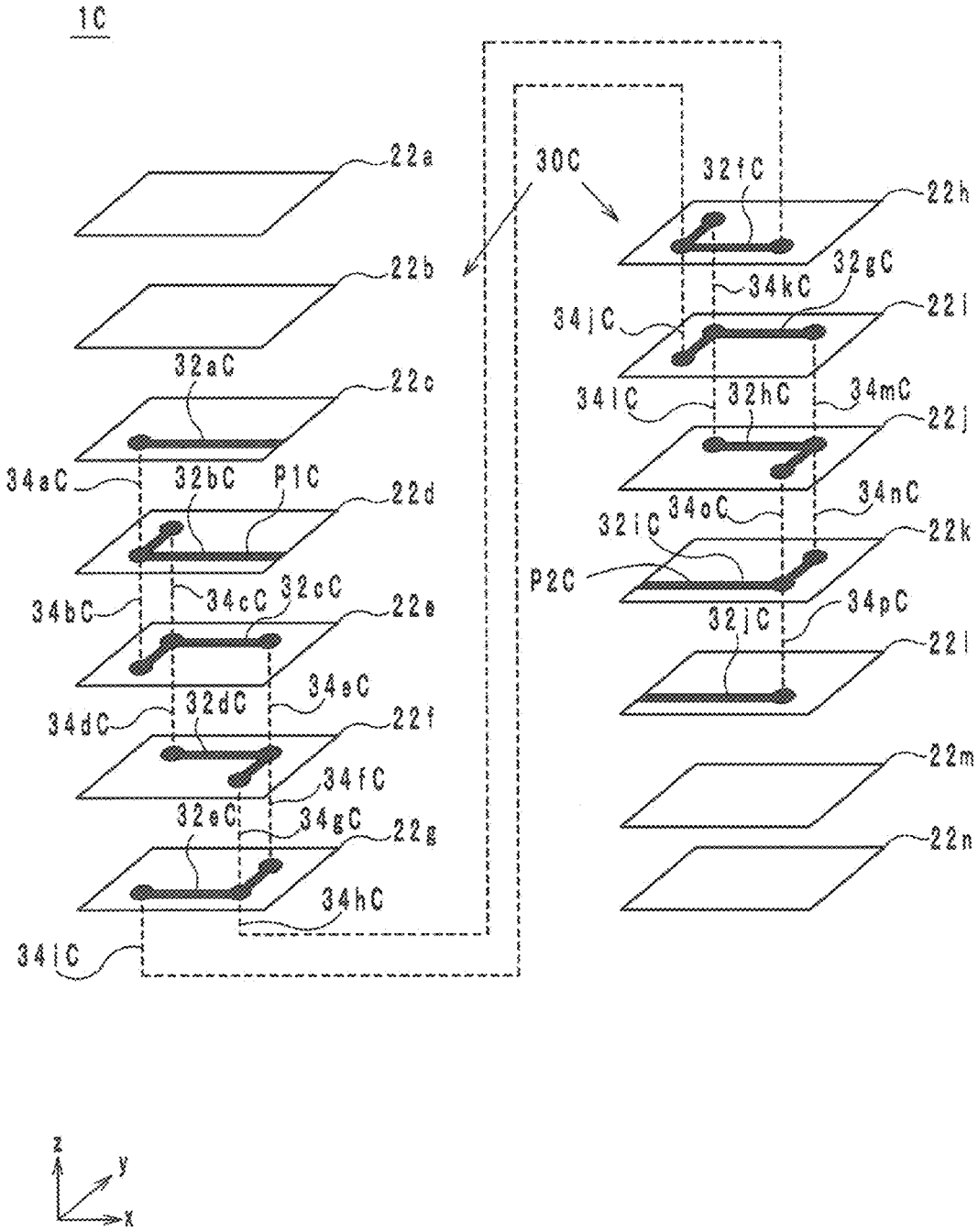
FIG. 5 is an exploded oblique view of the electronic component described as the third example.
Figure 6:
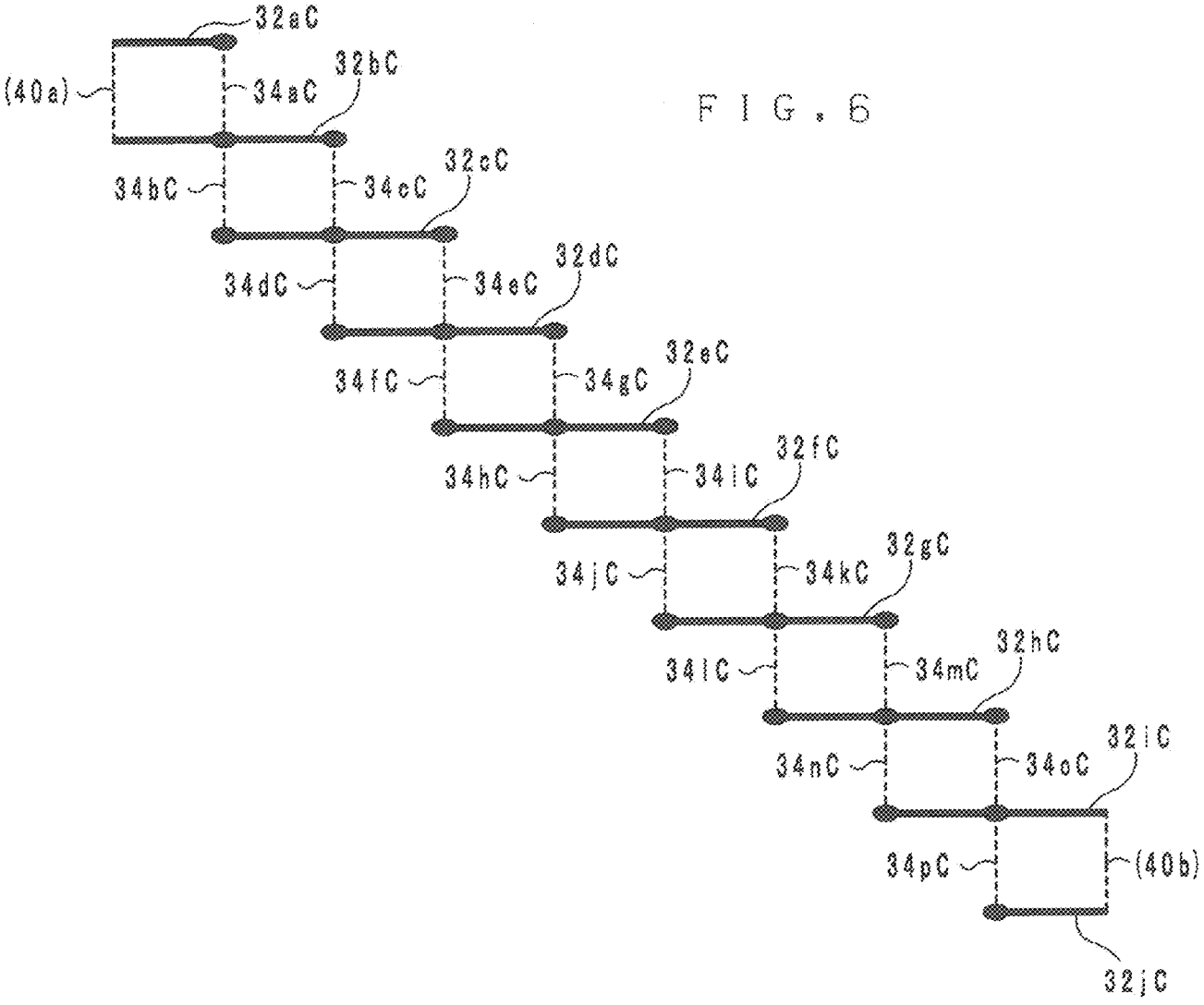
FIG. 6 is a development view of a helical coil of the electronic component described as the third example.

The configuration of an electronic component 1C, which is a third example, will be described below with reference to the drawings. FIG. 4 is an external oblique view of the electronic component 1C described as the third example. FIG. 5 is an exploded oblique view of the electronic component 1C. FIG. 6 is a development view of a helical coil 30C of the electronic component 1C. Note that the definitions of the x-, y-, and z-axis directions in FIGS. 4 and 5 are the same as in FIGS. 1 and 2.

The electronic component 1C differs from the electronic component 1A described as the first example, mainly in that coil conductors in each coil conductor pair having one insulator layer provided therebetween and overlapping each other when viewed in the z-axis direction are connected in parallel. Moreover, in the electronic component 1C, the total number of insulator layers and the number of insulator layers with coil conductors provided thereon are reduced when compared to the electronic component 1A. In addition, the electronic component 1C differs from the electronic component 1A in terms of the positions where the external electrodes 40*a* are 40*b* provided. Any descriptions of common points with the electronic component 1A will be omitted. Note that the laminate of the electronic component 1C will be denoted by 20C, and the coil will be denoted by 30C. In addition, the coil conductors of the electronic component 1C will be denoted by 32*a*C to 32*j*C, and the via-conductors will be denoted by 34*a*C to 34*p*C. Moreover, in FIGS. 4 and 5, the same elements as in the electronic component 1A will be denoted by the same reference characters.

In the electronic component 1C, the external electrode 40*a* is provided on the surface of the laminate 20C that is located on the positive side in the x-axis direction, and the external electrode 40*b* is provided on the surface of the laminate 20C that is located on the negative side in the x-axis direction, as shown in FIG. 4.

The laminate 20C of the electronic component 1C is formed by laminating the insulator layers 22*a* to 22*n* in this order, from the positive side in the z-axis direction, as shown in FIG. 5. Moreover, the coil 30C is provided in the laminate 20C, in a helical form having a central axis parallel to the direction of lamination. In addition, the coil 30C is exposed on opposite sides from the surface of the laminate 20C, so as to be connected to the external electrodes 40*a* and 40*b*.

The coil conductors 32*a*C to 32*j*C, which constitute the coil 30C, are provided on the top surfaces of the insulator layers 22*c* to 22*l*, so as to be arranged in the same order, from the positive side in the z-axis direction, as shown in FIG. 5. Moreover, the coil conductors 32*a*C and 32*j*C, which are positioned at opposite ends of the coil 30C, are linear conductors parallel to the x-axis, and their length is a quarter of a turn. The coil conductors 32*b*C to 32*i*C are L-shaped conductors, each consisting of two parts respectively parallel to the x- and y-axes, and their length is a half turn.

The coil conductor 32*a*C, when viewed in the z-axis direction, overlaps section P1C, which is parallel to the x-axis direction and constitutes a part of the coil conductor 32*b*C neighboring the coil conductor 32*a*C with the insulator layer 22*c* provided therebetween, as shown in FIG. 5. In addition, the coil conductor 32*a*C is connected parallel to section P1C of the coil conductor 32*b*C by the external electrode 40*a* and the via-conductor 34*a*C.

The coil conductors 32*b*C to 32*i*C are in a helical form as a whole, in which, when viewed in the z-axis direction, each coil conductor neighboring another coil conductor with one insulator layer provided therebetween overlaps the other coil conductor by a quarter of a turn, as shown in FIG. 5. Moreover, the portions where the coil conductors overlap by a quarter of a turn are connected in parallel by their respective via-hole conductors 34*b*C to 34*o*C. More specifically, a downstream portion of the coil conductor 32*b*C, which spans a quarter of a turn, overlaps an upstream portion of the coil conductor 32_c_C, which spans a quarter of a turn. Moreover, the portions of the coil conductors 32_b_C and 32_c_C that overlap each other by a quarter of a turn are connected in parallel by the via-hole conductors 34_b_C and 34_c_C. Note that pairs of coil conductors 32_c_C to 32_i_C neighboring in the z-axis direction have a similar relationship to the coil conductors 32_b_C and 32_c_C.

The coil conductor 32_j_C, when viewed in the z-axis direction, overlaps section P2C, which is parallel to the x-axis direction and constitutes a part of the coil conductor 32_i_C neighboring the coil conductor 32_j_C with the insulator layer 22_k_ provided therebetween, as shown in FIG. 5. In addition, the coil conductor 32_j_C is connected parallel to section P2C of the coil conductor 32_j_C by the external electrode 40_b_ and the via-conductor 34_p_C.

The electronic component 1C thus configured achieves the same effects as achieved by the electronic component 1A described as the first example. Moreover, the coil conductors 32_a_C to 32_j_C of the electronic component 1C, each coil conductor being paired with a neighboring coil conductor with one insulator layer provided therebetween and overlapping the neighboring coil conductor when viewed in the z-axis direction, are connected parallel to their respective neighboring coil conductors, as shown in FIG. 6. On the other hand, a part of the coil conductors of the electronic component 1A, e.g., the pair of coil conductors 32_c_ and 32_d_, does not have portions connected in parallel. Therefore, electrical resistance increases in the electronic component 1A compared to the electronic component 1C. That is, the electronic component 1C has lower electrical resistance than the electronic component 1A.

Furthermore, the coil conductors 32_c_C, 32_e_C, and 32_g_C of the electronic component 1C are approximately in the same shape having a length of a half turn. Moreover, the same can be said of the coil conductors 32_d_C, 32_f_C, and 32_h_C. Accordingly, only two coil patterns are required for forming the coil conductors 32_c_C to 32_h_C. That is, the electronic component 1C allows a simplified production process.

Fourth Example

Figure 7:
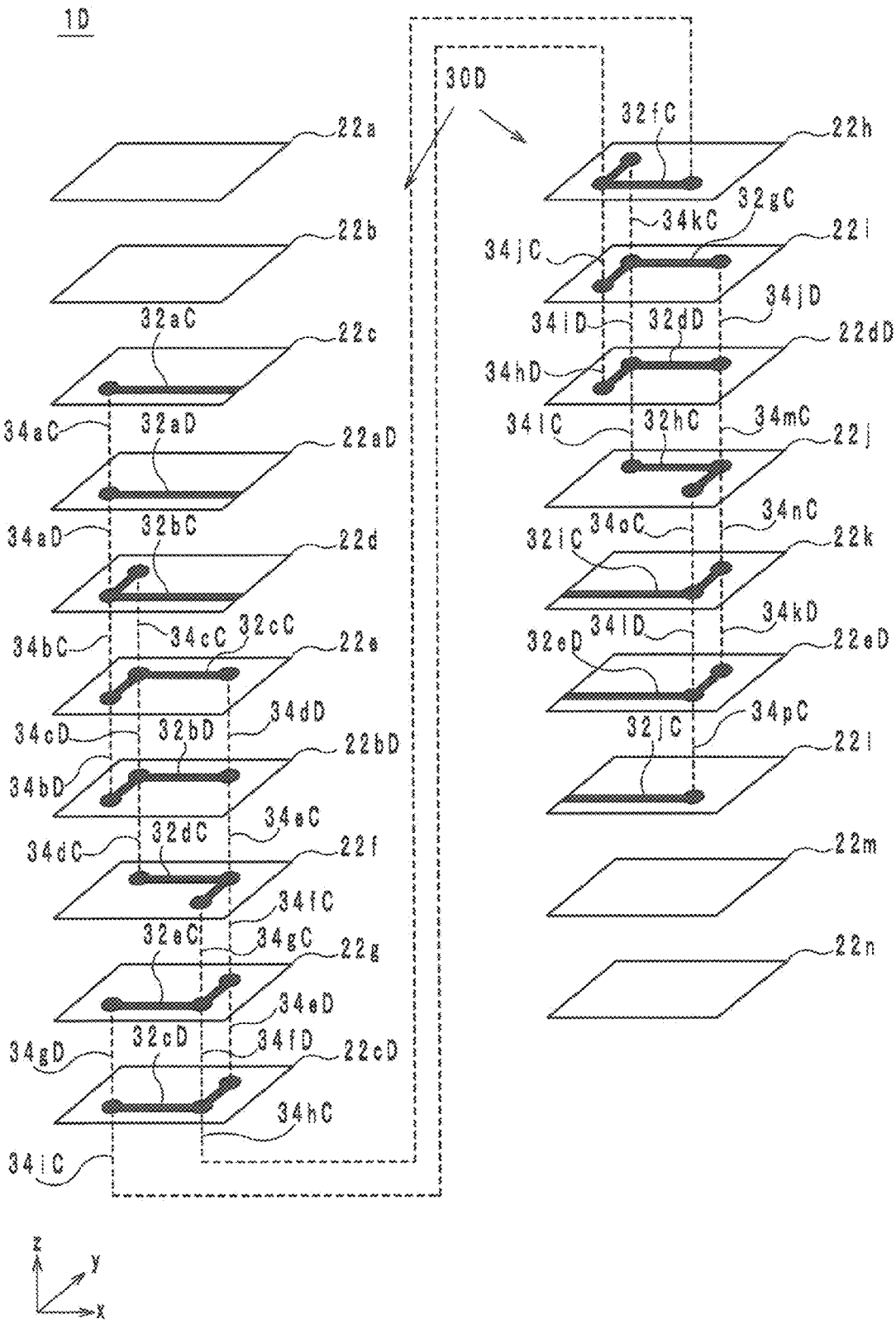
FIG. 7 is an exploded oblique view of the electronic component described as the fourth example.
Figure 8:
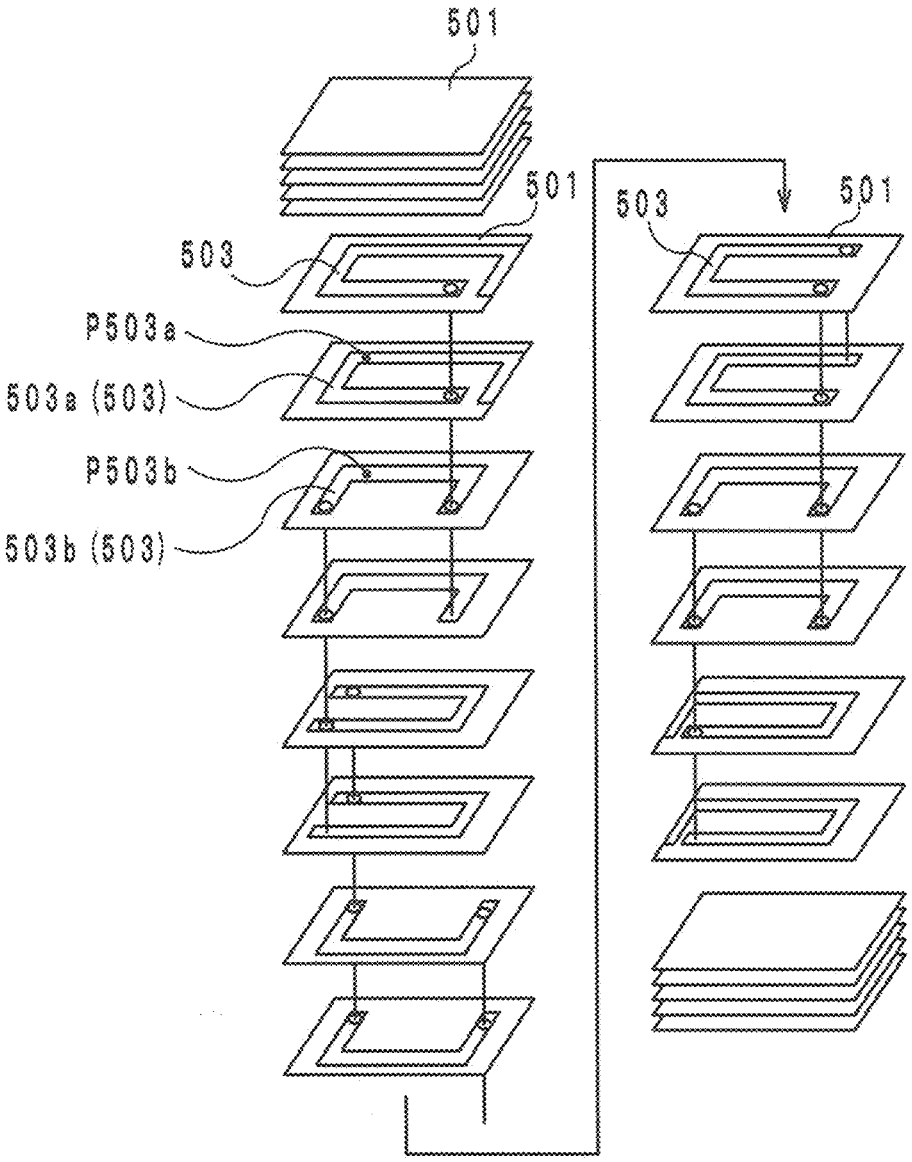
FIG. 8 PRIOR ART
FIG. 8 is an exploded oblique view of an electronic component disclosed in Japanese Utility Model Laid-Open Publication No. 5-57817.

The configuration of an electronic component 1D, which is a fourth example, will be described below with reference to the drawings. FIG. 7 is an exploded oblique view of the electronic component 1D described as the fourth example. Note that the definitions of the x-, y-, and z-axis directions in FIG. 7 are the same as in FIG. 2. For the external view of the electronic component 1D, FIG. 4 will be referenced.

The electronic component 1D differs from the electronic component 1C described as the third example, mainly in that additional coil conductors and insulator layers are provided, so that more coil conductors are connected in parallel. Any descriptions of common points with the electronic component 1C will be omitted. Note that the laminate of the electronic component 1D will be denoted by 20D, and the coil will be denoted by 30D. In addition, the coil conductors of the electronic component 1D that are additional to the electronic component 1C will be denoted by 32_a_D to 32_e_D, and the additional insulator layers will be denoted by 22_a_D to 22_e_D. Moreover, additional via-hole conductors provided along with the additional coil conductors and insulator layers will be denoted by 34_a_D to 34_l_D. Further, in FIG. 7, the same elements as in the electronic component 1C will be denoted by the same reference characters.

The electronic component 1D includes more insulator layers, coil conductors, and via-conductors than the electronic component 1C. Specifically, the additional insulator layer 22_a_D is provided between the insulator layers 22_c_ and 22_d_, and has provided thereon the coil conductor 32_a_D having the same shape as the coil conductor 32_a_C, as shown in FIG. 7. Correspondingly, the additional via-conductor 34_a_D is provided in order to connect the coil conductors 32_a_C, 32_b_C, and 32_a_D. As a result, the coil conductors 32_a_C, 32_b_C, and 32_a_D are connected in parallel at portions that overlap one another when viewed in the z-axis direction.

Furthermore, the electronic component 1D has the additional insulator layer 22_b_D provided between the insulator layers 22_e_ and 22_f_, and the insulator layer 22_b_D has provided thereon the coil conductor 32_b_D having the same shape as the coil conductor 32_c_C, as shown in FIG. 7. Correspondingly, the additional via-conductors 34_b_D to 34_d_D are provided in order to connect the coil conductors 32_c_C, 32_d_C, and 32_b_D. As a result, the coil conductors 32_b_C, 32_c_C, and 32_b_D are connected in parallel at portions that overlap one another when viewed in the z-axis direction, and the coil conductors 32_c_C, 32_d_C, and 32_b_D are connected in parallel at portions that overlap one another when viewed in the z-axis direction.

Furthermore, the electronic component 1D has the additional insulator layer 22_c_D provided between the insulator layers 22_g_ and 22_h_, and the insulator layer 22_c_D has provided thereon the coil conductor 32_c_D having the same shape as the coil conductor 32_e_C, as shown in FIG. 7. Correspondingly, the additional via-conductors 34_e_D to 34_g_D are provided in order to connect the coil conductors 32_e_C, 32_f_C, and 32_c_D. As a result, the coil conductors 32_d_C, 32_e_C, and 32_c_D are connected in parallel at portions that overlap one another when viewed in the z-axis direction, and the coil conductors 32_e_C, 32_f_C, and 32_c_D are connected in parallel at portions that overlap one another when viewed in the z-axis direction.

Furthermore, the electronic component 1D has the additional insulator layer 22_d_D provided between the insulator layers 22_i_ and 22_j_, and the insulator layer 22_d_D has provided thereon the coil conductor 32_d_D having the same shape as the coil conductor 32_g_C, as shown in FIG. 7. Correspondingly, the additional via-conductors 34_h_D to 34_j_D are provided in order to connect the coil conductors 32_g_C, 32_h_C, and 32_d_D. As a result, the coil conductors 32_f_C, 32_g_C, and 32_d_D are connected in parallel at portions that overlap one another when viewed in the z-axis direction, and the coil conductors 32_g_C, 32_h_C, and 32_d_D are connected in parallel at portions that overlap one another when viewed in the z-axis direction.

Furthermore, the electronic component 1D has the additional insulator layer 22_e_D provided between the insulator layers 22_k_ and 22_l_, and the insulator layer 22_e_D has provided thereon the coil conductor 32_e_D having the same shape as the coil conductor 32_i_C, as shown in FIG. 7. Correspondingly, the additional via-conductors 34_l_D and 34_k_D are provided in order to connect the coil conductors 32_i_C, 32_j_C, and 32_e_D. As a result, the coil conductors 32_h_C, 32_i_C, and 32_e_D are connected in parallel at portions that overlap one another when viewed in the z-axis direction, and the coil conductors 32_i_C, 32_j_C, and 32_e_D are connected in parallel at portions that overlap one another when viewed in the z-axis direction.

The electronic component 1D thus configured achieves the same effects as achieved by the electronic component 1A described as the first example. Moreover, the electronic component 1D has the additional coil conductors and insulator layers, so that each set of three coil conductors is connected in parallel. Thus, the electronic component 1D has lower electrical resistance than the electronic component 1C with each pair of coil conductors being connected in parallel.

Other Examples

The present disclosure is not limited to the above examples, and variations can be made within the spirit and scope of the disclosure. For example, the material, shape, and size of the insulator layers may be suitably selected in accordance with use. Moreover, the material, shape, and size of the coil may be suitably selected in accordance with use without departing from the spirit and scope of the disclosure. Further, the configuration of one example of the present disclosure may be combined with the configuration of another example.

Although the present disclosure has been described in connection with the preferred embodiment above, it is to be noted that various changes and modifications are possible to those who are skilled in the art. Such changes and modifications are to be understood as being within the scope of the disclosure.

What is claimed is:

1. An electronic component comprising:

a laminate formed by laminating a plurality of insulator layers;

a coil provided in the laminate and including a plurality of coil conductors connected by via-conductors piercing through the insulator layers, the coil winding helically about an axis along a direction of lamination;

external electrodes provided on surfaces of the laminate;

at least some pairs of the coil conductors that neighbor each other with one of the insulator layers provided therebetween having parallel sections overlapping each other when viewed in the direction of lamination, the parallel sections being connected in parallel by the via-conductors or the external electrodes; and each pair of the coil conductors neighboring each other with one of the insulator layers provided therebetween not overlapping each other when viewed in the direction of lamination, except for the parallel sections and connections between the coil conductors and the via-conductors.

2. The electronic component according to claim 1, wherein each pair of the coil conductors that neighbor each other with one of the insulator layers provided therebetween have the parallel sections that overlap each other when viewed in the direction of lamination.

3. The electronic component according to claim 1, wherein, the insulator layers include first and second insulator layers, the second insulator layer having lower porosity than the first insulator layer, and at least one second insulator layer is provided between the coil conductors that are separated by more than one of the insulator layers, that overlap each other when viewed in the direction of lamination, and that are connected in a series.

4. The electronic component according to claim 3, wherein the first insulator layer and the second insulator layer alternate in a part of the laminate.

5. The electronic component according to claim 2, wherein, the insulator layers include first and second insulator layers, the second insulator layer having lower porosity than the first insulator layer, and at least one second insulator layer is provided between the coil conductors that are separated by more than one of the insulator layers, that overlap each other when viewed in the direction of lamination, and that are connected in a series.

6. The electronic component according to claim 5, wherein the first insulator layer and the second insulator layer alternate in a part of the laminate.

* * * * *